US006041961A

United States Patent [19]

Farrell

[11] Patent Number: 6,041,961

[45] Date of Patent: Mar. 28, 2000

[54] CUP WITH ANTI-ROTATION MECHANISM

[75] Inventor: James J. Farrell, Orinda, Calif.

[73] Assignee: f'Real! Foods, LLC, Orinda, Calif.

[21] Appl. No.: 09/189,785

[22] Filed: Nov. 10, 1998

Related U.S. Application Data

[60] Provisional application No. 60/085,431, May 14, 1998.

[51] Int. Cl.[7] ..... B65D 25/00

[52] U.S. Cl. ..... 220/608; 220/636; 220/729

[58] Field of Search ..... 220/608, 636, 220/818, 729, 739

[56] References Cited

U.S. PATENT DOCUMENTS

| | | | |
|---|---|---|---|
| 37,046 | 12/1862 | Mackey et al. | 220/636 |
| 496,674 | 5/1893 | Urbach . | |
| 934,537 | 9/1909 | Johnson . | |
| 1,313,830 | 8/1919 | Minsk . | |
| 2,026,240 | 12/1935 | Luxmore . | |
| 2,072,691 | 3/1937 | Stark | 99/60 |
| 2,115,809 | 5/1938 | Goldman . | |
| 2,701,131 | 2/1955 | Love . | |
| 2,898,094 | 6/1959 | O'Neill, Jr. . | |
| 2,941,885 | 6/1960 | Tomlinson . | |
| 2,967,433 | 1/1961 | Phillips . | |
| 3,154,123 | 10/1964 | Tomlinson . | |
| 3,171,635 | 3/1965 | Haentjens et al. . | |
| 3,295,997 | 1/1967 | Tomlinson | 99/275 |
| 3,503,757 | 3/1970 | Rubenstein | 99/136 |
| 3,514,080 | 5/1970 | Price et al. . | |
| 3,738,619 | 6/1973 | Shirae | 259/108 |
| 4,169,681 | 10/1979 | Kato | 366/244 |
| 4,297,379 | 10/1981 | Topalian et al. | 426/565 |
| 4,358,298 | 11/1982 | Ratcliff . | |
| 4,431,682 | 2/1984 | Smith et al. | 426/565 |
| 4,434,186 | 2/1984 | Desia et al. | 426/565 |
| 4,542,035 | 9/1985 | Huang et al. | 426/565 |
| 4,544,277 | 10/1985 | Schnellmann . | |
| 4,547,076 | 10/1985 | Maurer | 366/244 |
| 4,609,561 | 9/1986 | Wade et al. | 426/565 |
| 4,708,487 | 11/1987 | Marshall . | |
| 4,818,554 | 4/1989 | Giddey et al. | 426/564 |
| 4,830,868 | 5/1989 | Wade et al. | 426/565 |
| 4,988,529 | 1/1991 | Nakaya et al. | 426/569 |
| 5,000,974 | 3/1991 | Albersmann et al. | 426/564 |
| 5,112,626 | 5/1992 | Huang et al. | 426/43 |
| 5,150,967 | 9/1992 | Nelson et al. . | |
| 5,178,351 | 1/1993 | Lesage | 220/636 |
| 5,186,350 | 2/1993 | McBridge | 220/636 |
| 5,328,263 | 7/1994 | Neilson | 366/254 |
| 5,439,289 | 8/1995 | Neilson | 366/207 |
| 5,465,891 | 11/1995 | Bridges | 220/636 |
| 5,474,206 | 12/1995 | Herring, Sr. | 220/636 |
| 5,580,007 | 12/1996 | Caviezel et al. | 241/199.12 |
| 5,599,103 | 2/1997 | Linscott | 366/343 |
| 5,803,377 | 9/1998 | Farrell | 241/36 |

FOREIGN PATENT DOCUMENTS

| | | | |
|---|---|---|---|
| 804966 | 1/1969 | Canada | 220/608 |
| 2158002 | 5/1973 | Germany . | |

*Primary Examiner*—Joseph M. Moy
*Attorney, Agent, or Firm*—Limbach & Limbach

[57] ABSTRACT

A container for containing food and/or beverage ingredients is described. The container is of a type which may be supported in a cup holder while the ingredients inside are processed, such as by a rotating blade or other mechanism, and which is restrained against rotation which would otherwise be caused by the action of the rotating blade or other processing tool. In a preferred embodiment, a non-circular anti-rotation pattern is formed on the cup bottom for mating with a corresponding pattern on a cup holder.

29 Claims, 6 Drawing Sheets

CUP WITH ANTI-ROTATION MECHANISM

This application claims the benefit of U.S. Provisional Application Ser. No. 60/085,431, filed May 14, 1998.

FIELD OF THE INVENTION

The present invention relates generally to the field of food and beverage containers and specifically to containers for holding foods and/or beverages during blending, whipping, stirring, etc.

BACKGROUND OF THE INVENTION

Preparation of certain foods and beverages can involve blending, whipping, stirring, etc. the food or beverage using a rotary blade or mixer which is lowered into a container holding the food or beverage.

In Applicant's Published International Application No. PCT/US97/08250 entitled APPARATUS AND METHOD FOR MAKING FROZEN DRINKS, the disclosure of which is incorporated herein by reference, a method for making frozen drinks is described. The application describes an apparatus which allows milkshakes and other frozen drinks to be quickly made by breaking up pre-frozen blocks of ingredients into small frozen particles using a rotating blade, and blending them with an added liquid also using the rotating blade. The ingredients to be frozen into frozen blocks are pre-mixed in liquid form, placed into serving cups which are the same serving cups in which the finished milkshake or frozen drinks are to be served, and then frozen into blocks conforming to the insides of the serving cups and stored.

According to the disclosure, when a milkshake or other frozen drink is to be made, a serving cup containing the frozen block is positioned in a cup holder which forms a part of the frozen drink machine. A rotating blade is lowered into the cup and bores through the frozen substance in the cup, grinding it into small frozen particles. Milk, water, or another liquid is added to the cup and is blended into the frozen substance by the rotating blade. The rotating blade also whips air into the frozen particle mixture in order to give the milkshake or frozen drink its proper volume, texture, and flavor delivery.

In this and other contexts, it is desirable to provide a container for a frozen drink (or other food or beverage) which may be supported in a cup holder while the ingredients the container inside are processed, and which is restrained against rotation which would otherwise be caused by the action of the rotating blade or other processing tool. It is further desirable to provide a container having an anti-rotation feature and which is further suitable for serving directly to customers after its removal from the cup holder.

SUMMARY OF THE INVENTION

The present invention is a container having an anti-rotation pattern formed on an exterior surface of the container. During use, the container is positioned in a cup holder having a corresponding pattern, so that the anti-rotation pattern on the cup engages with the corresponding pattern on the cup holder to prevent rotation of the container during processing of the ingredients inside the cup.

DETAILED DESCRIPTION

Figure 1:
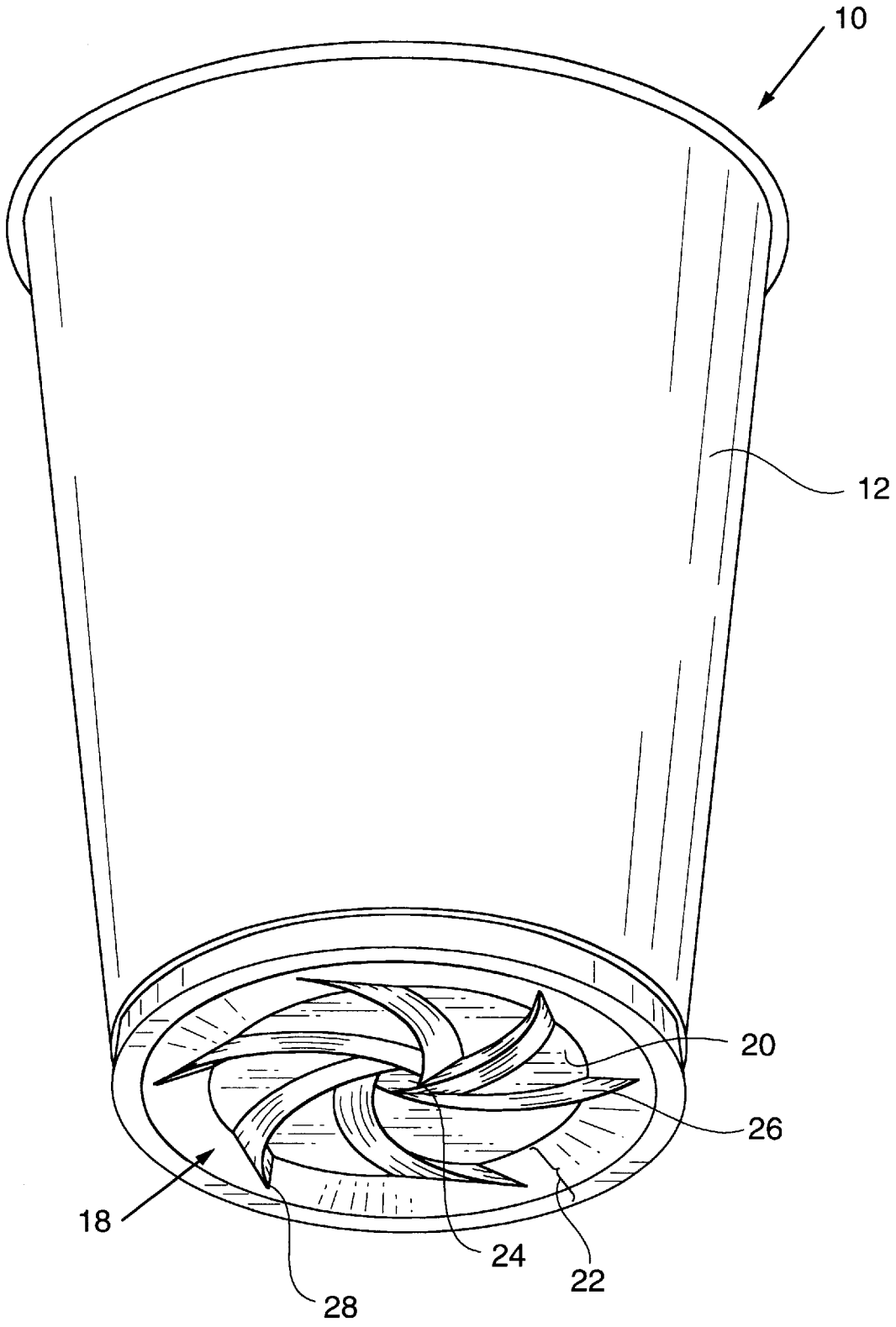
FIG. 1 is a bottom perspective view of a container according to the present invention.

FIG. 1 shows a perspective view of a container 10 according to the present invention. Container 10 (which will also be referred to as a cup) includes a cup wall 12 that defines an interior 14, and a cup bottom 16. During use, the container 10 contains food or beverage ingredients that are to be processed inside the cup using a rotating blade or other boring and/or blending device. Container 10 is provided with an antirotation mechanism designed to engage the container with a cup holder associated with the boring/blending device so as to prevent rotation of the cup during processing.

In one embodiment, anti-rotation pattern 18 is formed in the cup bottom 16. In a preferred embodiment, pattern 18 is in the form of the pinwheel pattern shown in FIGS. 1 and 2. The pattern 18 is designed to mate with a corresponding pattern 18*a* (see FIG. 5) in a cup holder 42 which holds the container during processing of the food or beverage ingredients inside the container. The pattern 18 should therefore include at least one inwardly or outwardly protruding portion which will engage with a corresponding mating portion on the cup holder 42.

Figure 2:
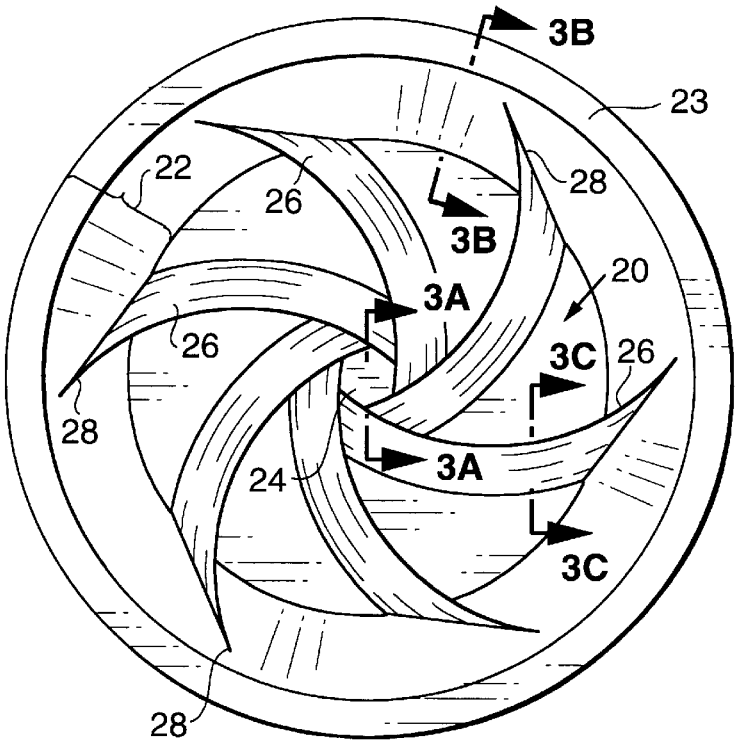
FIG. 2 is a bottom view of the container of FIG. 1.
Figure 3A:
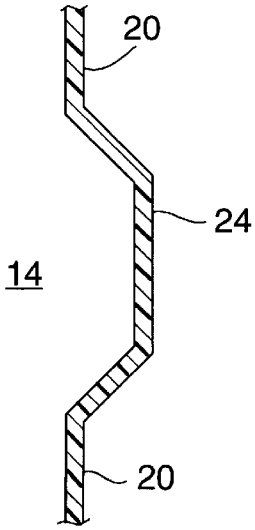
FIGS. 3A, 3B and 3C are cross-section views of the container bottom shown in FIG. 2, taken along the planes designated 3A—3A, 3B—3B and 3C—3C, respectively.
Figure 3B:
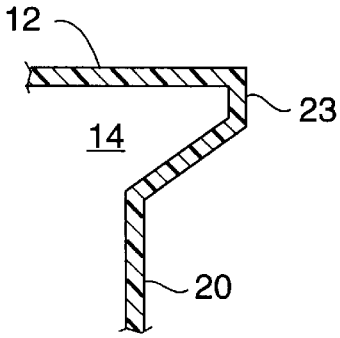
Figure 6:
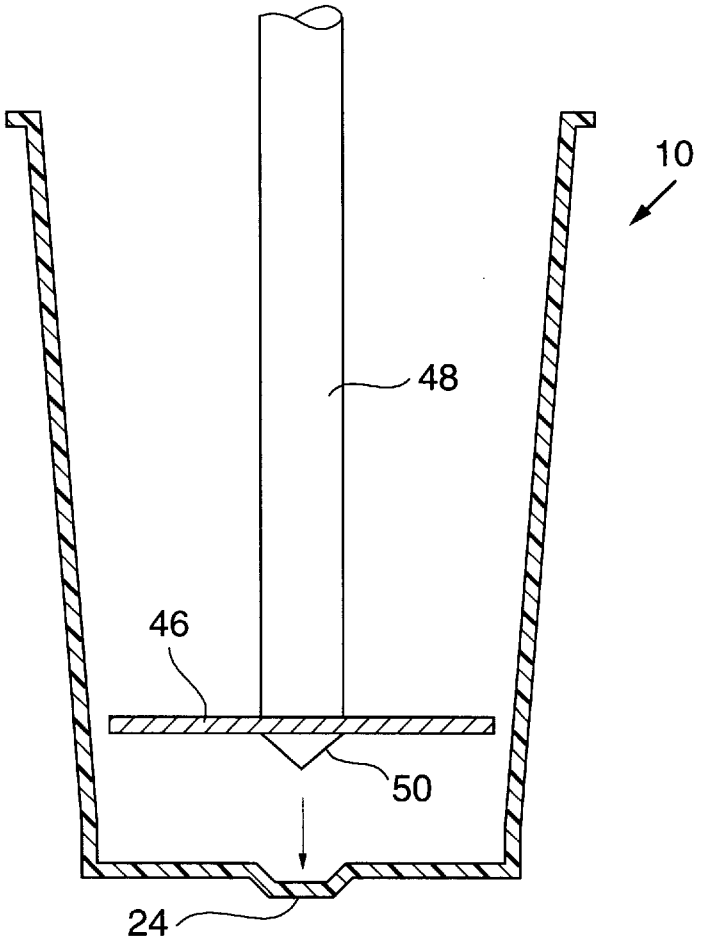
FIG. 6 is a side section view of a cup according to the present invention, showing the blade from the drink machine of FIG. 5 being lowered into the cup, and further showing the circular recessed portion of the cup bottom as the anti-rotation pattern.

Referring to FIG. 2, the cup bottom includes a circular center section 20 and a circumferential section 22 surrounding center section 20. Circumferential section includes an edge section 23 which is recessed below center section 20 (as viewed from the cup interior 14). See FIG. 3B. The cup bottom 16 further includes a recessed center portion 24 (as viewed from the cup interior) centered in the circular center section 20 as shown in FIG. 3A. Recessed center portion 24 may have a non-circular shape, such as the six-sided shape shown in FIG. 2. By giving portion 24 a non-circular shape, it contributes to the anti-rotation features of the container 10 by mating with a correspondingly shaped section in the cup holder. As shown in FIG. 6, the portion 24 may be alternatively provided on its own as the anti-rotation pattern.

Referring again to FIGS. 1 and 2, the anti-rotation pattern 18 includes a plurality of arcuate ridges 26 radiating from the recessed center portion 24 and extending downwardly from the bottom surface of center section 20. Trailing edges 28 extend from each arcuate ridge 26 into the circumferential section 22.

Figure 3C:
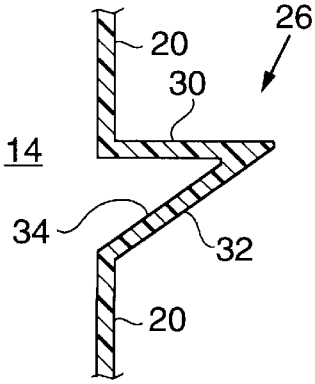

As shown in FIG. 3C, each arcuate ridge 26 preferably includes a triangular cross-section, formed by a first side wall 30 which is approximately vertically oriented with respect to the center section 20, and a second side wall 32 which extends angularly between center section 20 and first side wall 30. In a preferred embodiment of the container, the walls 30, 32 are joined at an angle of approximately 45°. The portion of the ridge 26 facing the cup interior 14 forms a groove 34.

The triangular configuration of the anti-rotation pattern enhances the rigidity of the cup during use by creating a triangular structural element and by allowing the cup's ingredients to freeze down into the groove 34 created by the angled side to form a frozen, rigid backing for the anti-rotation pattern. The other side wall 30 is approximately straight up and down so that as it resists rotation by pressing against a corresponding cup holder member, there is no upward force created, as would be the case if it were angled like the other side. In fact, by bringing this face past vertical, a downward force can be generated which helps to keep the cup seated on the holder as torque is applied.

Another advantage of the angled side wall 32 of the anti-rotation pattern 18 in the cup bottom is that this angle acts as a self aligning mechanism, so that if a cup 10 is placed in the cup holder 42 and the sloped side wall 32 contacts the corresponding mating member of the cup holder before the cup is fully seated, the angle of wall 32 causes the cup to twist slightly so that the cup slides into a fully engaged position within the anti-rotation pattern in the cup holder. Therefore, little care is required to properly place the cup in the cup holder.

It should be noted that shapes other than a triangular cross-section, such as a rectangular cross-section, would also be quite effective in preventing rotation and (as with the triangular cross-section) would have the benefit of added strength due to their wide cross-section at the point where they meet the cup bottom. They would also posses the advantage of allowing the cup's ingredients to freeze down into the rectangular or other shaped groove created by the cross-section to form a frozen, rigid backing for the anti-rotation pattern.

Figure 4A:
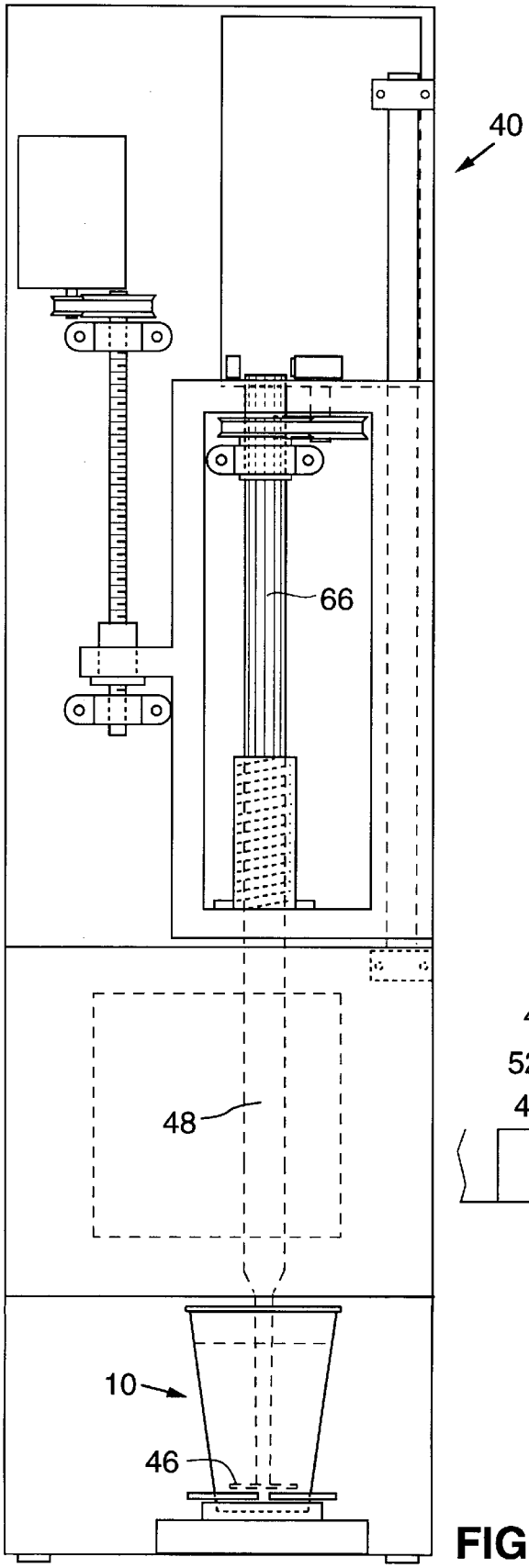
FIG. 4A is a front elevation view of a frozen drink machine of a type, which may be used, with the container of the present invention.
Figure 4B:
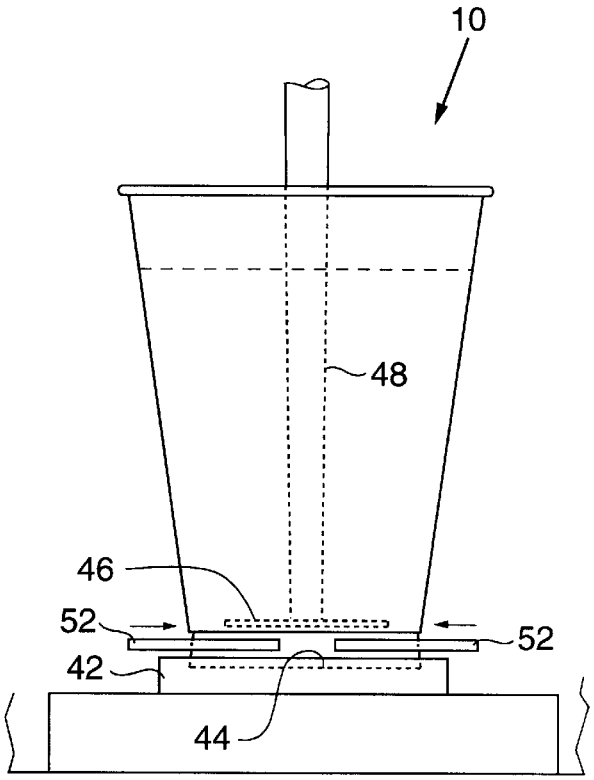
FIG. 4B is a front elevation view of the cup holder of the frozen drink machine of FIG. 4A.
Figure 5:
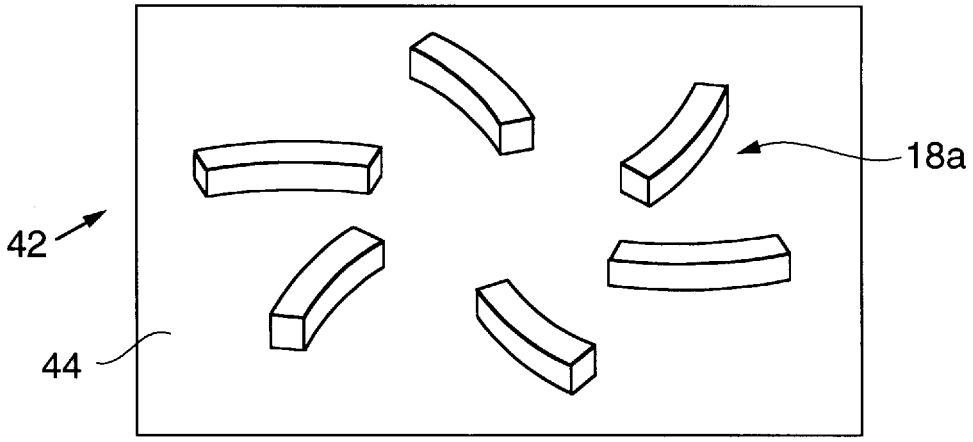
FIG. 5 is a perspective view of an anti-rotation pattern positioned within a cup holder for the frozen drink machine of FIG. 4A and which may be used to support the container of the present invention.

FIG. 4A illustrates a frozen drink machine 40 of a type that may utilize a container 10 according to the present invention. The frozen drink machine 40 includes a cup holder 42 having a recessed portion 44 for receiving the container 10. As shown in FIG. 5, recessed portion 44 includes the anti-rotation pattern 18a designed to mate with anti-rotation pattern 18 on the cup bottom 16. The frozen drink machine 10 further includes a rotatable blade 46 that rotates on a shaft 48. Rotatable blade 46 may include a protruding tip 50.

During use of container 10 with the frozen drink machine 40, the container is positioned in recessed portion 44 of cup holder 42 as shown in FIG. 4A. The anti-rotation pattern 18 in the container mates with the corresponding anti-rotation pattern 18*a* in the cup holder, so that the container 10 remains in place during grinding and blending. The frozen drink machine may be equipped with gripping members 52 that move into contact with the exterior surface of the cup so as to restrain the cup against movement out of the holder during processing.

Rotatable blade 46 is lowered into the container 10, where it grinds the frozen ingredients in the container and where it blends the ground frozen ingredients with an added liquid. Tip 50 helps the blade to remain centered in the cup 10 when the blade is boring the frozen ingredients in the cup.

When the blade 46 is at the bottom of the container, tip 50 extends into recessed center portion 24. See FIG. 6. This allows the blade 46 to reach the bottom of the cup and therefore avoids puncturing the cup bottom 16 or leaving a layer of frozen ingredients on the cup bottom. The pattern 18 shown in FIG. 1 is not shown in FIG. 6 for clarity.

It should be understood, however, that the recessed portion 24 itself might serve as the anti-rotation pattern if used with a corresponding pattern on the cup holder.

After reaching the end of its downward travel, the spinning blade moves upwardly until it passes out of the cup.

Alternative Embodiments

Figure 7:
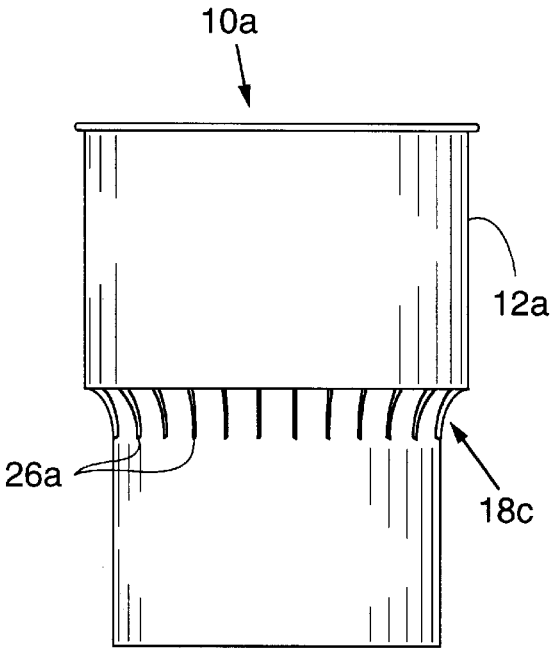
FIG. 7 is a side elevation view of an alternative embodiment of a container according to the present invention.

An anti-rotation pattern may also be formed on the side wall 12 of the container 10 without departing from the scope of the present invention. For example, referring to the container 10*a* in FIG. 7, the cup wall 12*a* may include an anti-rotation pattern 18*c* formed of a plurality of ribs 26*a* on its exterior surface. The cup holder (not shown) for container 10*a* is provided with a corresponding anti-rotation pattern, such as a plurality of grooves or ribs which engage with the ribs 26*a*. Alternatively, a cup may be provided to include anti-rotation patterns on both the side walls and the cup bottom.

Although the anti-rotation pattern on the side walls 12*a* works well for preventing rotation, there are a number of reasons that make it beneficial to position the anti-rotation pattern on or nearer to the cup bottom.

One primary benefit relates to use of the thermoformed container of the present invention with a frozen drink machine of the type described above. If irregularities are formed into the side walls in a thermoformed cup, there will be irregularities in both the inside and the outside walls of the cup, since the cup will have been formed using a thin sheet of material. Smooth, rather than patterned or irregular, side walls on the interior of the cup can be scraped clean by a rotating blade, whereas irregularly shaped walls cannot. Also, the frozen ingredients in the cup will accumulate in a pattern on the inside walls (as in the case of a thermoformed cup as discussed above) and therefore may not be reached by the rotating blade 46. Although cups having irregular outside walls and smooth inside walls can be made using injection molding, this process requires additional plastic resin and is thus more costly. Forming the irregularities on or near the cup bottom does not interfere with access by the rotating blade to the frozen cup ingredients on the cup's side walls.

Including the anti-rotation pattern at the cup bottom rather than on the side walls is further advantageous in that the downward pressure of the boring blade 46 forces the cup 10 downwardly into the cup holder 42. This keeps the cup and cup holder engaged with one another during the critical boring phase of the frozen drink machine's cycle, when torque on the cup is at its maximum.

Moreover, the frozen ingredients in the cup significantly contribute to cup rigidity. When a cup includes an anti-rotation mechanism in or on its side wall, and frozen ingredients are removed as the blade bores downwardly in the cup, the rigid backing contributed by the frozen ingredients for the anti-rotation pattern in the side walls is cut away by the boring blade. This reduces the ability of the cup to resist deformation and failure of the anti-rotation pattern as boring progresses.

It is therefore advantageous to have the anti-rotation pattern at the region of the cup in which the frozen ingredients will remain for the longest period of time during boring by boring blade 46, i.e. at or near the cup bottom.

An anti-rotation pattern on the cup bottom further allows a single cup holder to be used with a variety of cup sizes. Because the side walls 12 need not contact the cup holder, the anti-rotation pattern 18 may be utilized on cups having different diameter bottoms 16 and different side wall 12 angles. Each different cup size could be used with a single cup holder having the corresponding anti-rotation pattern 18*a*. An added benefit of avoiding contact between the side walls 12 and the cup holder is that if ingredients are spilled onto the cup holder, they will not adhere to the cup side walls where they can be seen by customers.

Yet another advantage of providing the anti-rotation pattern away from the cup side walls is that it leaves the exterior surfaces of the cup side walls 12 smooth for printing on the surface of the cup if desired.

Second and Third Alternative Embodiments

FIGS. 8A through 9B illustrate alternative embodiments of cups according to the present invention which utilize anti-rotation patterns which address the various concerns of side-wall patterns that are raised above.

Figure 8A:
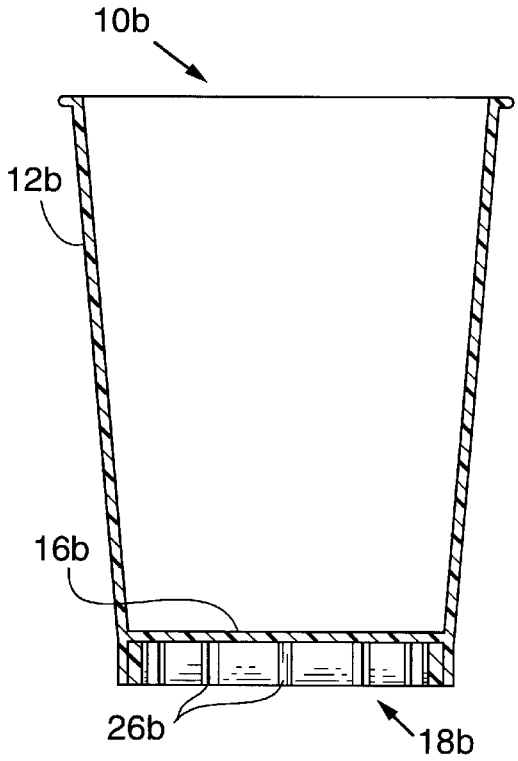
FIGS. 8A and 8B are a side section view and a bottom view, respectively, of a second alternative embodiment of a container according to the present invention.
Figure 8B:
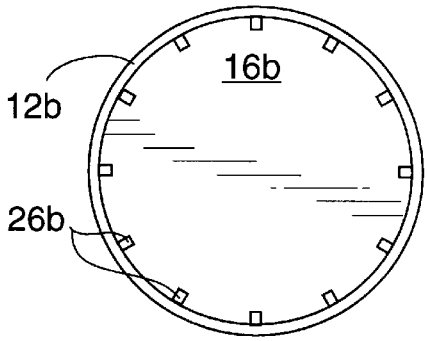

A second alternative embodiment of a container 10*b* is shown in FIGS. 8A and 8B. In the second alternative embodiment, the side walls 12*b* extend to form a skirt below the cup bottom 16*b*, and the anti-rotation pattern 18*b* is formed on the interior surface of the skirt, below the cup bottom 16*b*. In the embodiment of FIGS. 8A and 8B, the antirotation pattern is in the form of vertically oriented ribs 26*b*, but make the form of recesses or ribs in various patterns.

Figure 9A:
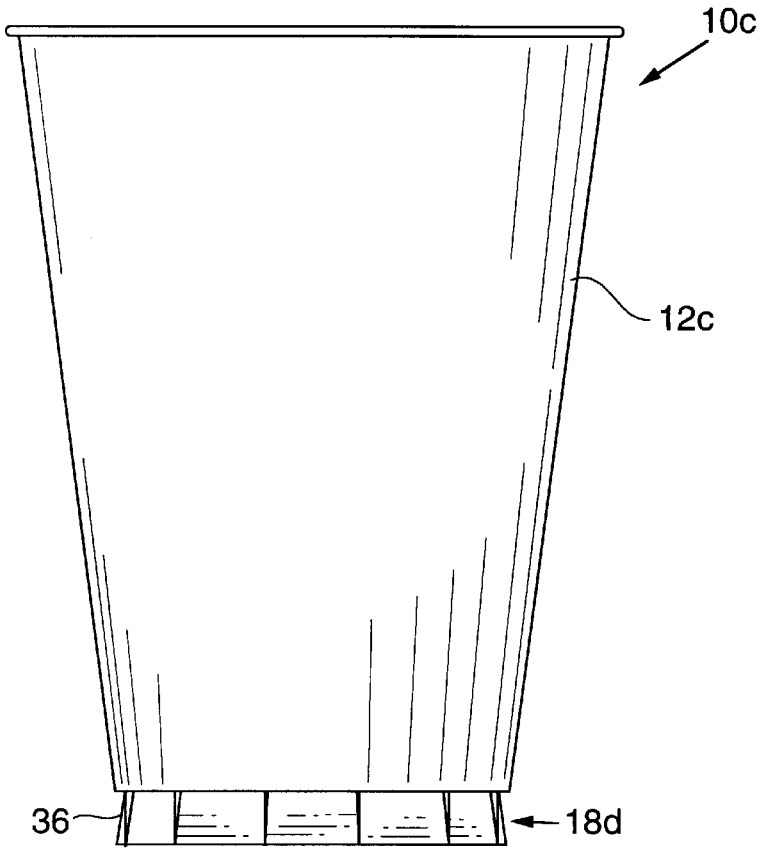
FIGS. 9A and 9B are a side elevation view and a bottom view, respectively, of a third alternative embodiment of a container according to the present invention.
Figure 9B:
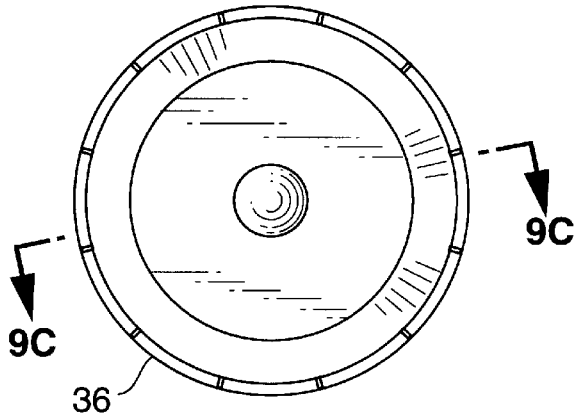
Figure 9C:
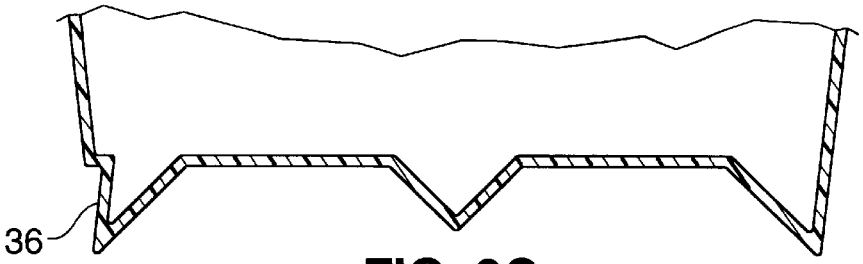
FIG. 9C is a cross-sectional side view of the cup bottom, taken along the plane designated 9C—9C in FIG. 9B.

A third alternative embodiment of a cup 10*c*, shown in FIGS. 9A and 9B, utilizes an anti-rotation pattern 18*c* on the reverse tapered portions of the side walls 12*c*. In this embodiment a region of the side walls has a slightly reduced diameter to form a stacking/nesting shoulder 36, as is commonly found in thermoformed cups. This region of the side walls has a reverse, or inward taper as opposed to the outward taper of the balance of side walls 12*c*. In the embodiment shown in FIGS. 9A and 9B, anti-rotation pattern 18*d* is located below the nesting/stacking shoulder 36 in the reverse tapered section. As with the other embodiments, the anti-rotation pattern may take a variety of forms, including ribs, indentations, or other texture patterns on the surface that mate with corresponding items on the cup holder.

As discussed, there are several reasons for which it is desirable to provide the cup with smooth interior and exterior side wall surfaces. In the second alternative embodiment, locating the anti-rotation pattern on the interior of the side walls below the cup bottom allows the cup to have these desirable characteristics and provides the further advantage of rotation prevention. In the third alternative embodiment, locating the anti-rotation pattern on the exterior of the side walls below the nesting/stacking shoulder in the reduced diameter region of the cup allows the cup to have all of these desirable characteristics above the nesting/stacking shoulder.

Several cups with anti-rotation mechanisms have been given as examples of cups that utilize principles of the present invention. It should be understood, however, that the embodiments described herein are for purposes of example only. It is the claims that follow rather than the descriptions of particular embodiments that define the scope of the present invention.

I claim:

1. A container receivable by a container support, the container comprising:

a side wall;

a bottom integrally attached to the side wall to form a vessel having a leakproof bottom portion, at least one of the side wall and the bottom including an anti-rotation pattern, the anti-rotation pattern including at least one inwardly or outwardly protruding portion engageable with a corresponding protruding portion in a container support in a manner which restricts rotational movement of the cup relative to the container support without preventing longitudinal movement of the cup relative to the cup support when the protruding portions are engaged with one another.

2. The container of claim 1 wherein the anti-rotation pattern includes an engageable protruding portion formed on or into the container bottom.

3. The container of claim 2 wherein the engageable protruding portion is widened at its meeting point with the cup bottom to add strength beyond that achieved without such widening.

4. The container of claim 3 wherein the engageable protruding portion includes a substantially triangular cross-section.

5. The container of claim 2 wherein the engageable protruding portion includes a plurality of ridges radiating from a center portion of the container bottom.

6. The container of claim 5 wherein the plurality of radiating ridges are arcuate.

7. The container of claim 1 wherein a downwardly protruding or recessed portion in the container includes the center of the container bottom.

8. The container of claim 1 wherein the engageable protruding portion is located on the side wall.

9. The container of claim 8 wherein the container side wall includes a nesting/stacking shoulder, and the engageable protruding portion is located on the container wall below the nesting/stacking shoulder.

10. The container of claim 1 wherein the side wall includes a skirt section extending below the container bottom, and wherein the engageable protruding portion includes a plurality of ribs on an interior side of the skirt section.

11. The container of claim 8 wherein the engageable protruding portion includes one or more spaced ribs or indents.

12. The container of claim 9 wherein the engageable protruding portion includes one or more spaced ribs or indents.

13. The container of claim 10 wherein the engageable protruding portion includes one or more spaced ribs or indents.

14. A container receivable by a container support, the container comprising:

a side wall;

a bottom attached to the side wall to form a vessel having an interior, at least one of the side wall and the bottom including an anti-rotation pattern, the anti-rotation pattern including at least one inwardly or outwardly protruding portion engageable with a corresponding protruding portion in a container support, the bottom wall including an interior surface facing the interior of the vessel and at least one recess formed in the interior surface.

15. The container of claim 14 wherein the recess is centrally disposed on the bottom wall.

16. The container of claim 14 wherein the anti-rotation pattern includes an engageable protruding portion formed on or into the container bottom.

17. The container of claim 16 wherein the engageable protruding portion is widened at its meeting point with the cup bottom to add strength beyond that achieved without such widening.

18. The container of claim 17 wherein the engageable protruding portion includes a substantially triangular cross-section.

19. The container of claim 16 wherein the non-circular engageable protruding portion includes a plurality of ridges radiating from a center portion of the container bottom.

20. The container of claim 19 wherein the plurality of radiating ridges are arcuate.

21. The container of claim 15 wherein at least one inwardly or outwardly protruding portion in the container includes the center of the container bottom.

22. The container of claim 14 wherein the engageable protruding portion is located on the side wall.

23. The container of claim 14 wherein the container side wall includes a nesting/stacking shoulder, and the engageable protruding portion is located on the container side wall below the nesting/stacking shoulder.

24. The container of claim 14 wherein the side wall includes a skirt section extending below the container bottom, and wherein the engageable protruding portion is located on an interior side of the skirt section.

25. The container of claim 22 wherein the engageable protruding portion includes one or more spaced ribs or indents.

26. The container of claim 23 wherein the engageable protruding portion includes one or more spaced ribs or indents.

27. The container of claim 24 wherein the engageable protruding portion includes one or more spaced ribs or indents.

28. A container receivable by a container support, the container comprising:

a side wall;

a bottom integrally attached to the side wall to form a vessel having a leakproof bottom portion, at least one of the side wall and the bottom including an anti-rotation pattern, the anti-rotation pattern including at least one inwardly or outwardly protruding portion engageable with a corresponding protruding portion in a container support in a manner which restricts rotation of the vessel relative to the container support in clockwise and counterclockwise directions.

29. A container receivable by a container support, the container comprising:

a side wall;

a bottom integrally attached to the side wall to form a vessel having a leakproof bottom portion, at least one of the side wall and the bottom including an anti-rotation pattern formed using injection molding or thermoforming techniques, the anti-rotation pattern including at least one inwardly or outwardly protruding portion engageable with a corresponding protruding portion in a container support and being free of substantial undercut regions which would unduly restrict release of the vessel from a mold during formation using injection molding or thermoforming techniques.

* * * * *